US006330863B1

(12) United States Patent
Lydic et al.

(10) Patent No.: US 6,330,863 B1
(45) Date of Patent: Dec. 18, 2001

(54) RAILROAD CAR TUB

(75) Inventors: Todd L. Lydic; William E. Kurtz, both of Johnstown, PA (US)

(73) Assignee: JAC Patent Company, Johnstown, PA (US)

( * ) Notice: Subject to any disclaimer, the term of this patent is extended or adjusted under 35 U.S.C. 154(b) by 0 days.

(21) Appl. No.: 09/561,152

(22) Filed: Apr. 28, 2000

Related U.S. Application Data

(60) Provisional application No. 60/131,395, filed on Apr. 28, 1999.

(51) Int. Cl.[7] ..... B61D 15/00; B61D 17/04; B61D 17/10

(52) U.S. Cl. ..... 105/355; 105/404; 105/406.1; 105/409

(58) Field of Search ..... 105/355, 404, 105/406.1, 409

(56) References Cited

U.S. PATENT DOCUMENTS 4,254,714 * 3/1981 Heap ..... 105/406
4,361,097 11/1982 Jones et al. .
4,579,065 * 4/1986 Zehnder ..... 105/411
5,216,958 6/1993 Kurtz .
5,341,747 * 8/1994 Fetterman et al. ..... 105/406.1
5,373,792 * 12/1994 Pileggi et al. ..... 105/406.1
5,443,016 * 8/1995 Erickson ..... 105/411
5,458,067 * 10/1995 Weiss et al. ..... 105/406.1
5,813,353 * 9/1998 Sauter ..... 105/406.1

* cited by examiner

*Primary Examiner*—Stephen T. Gordon
*Assistant Examiner*—Greg Blankenship
(74) *Attorney, Agent, or Firm*—Webb Ziesenheim Logsdon Orkin & Hanson, P.C.

(57) ABSTRACT

A railcar includes a pair of car tubs on opposite sides of a center sill. Each car tub includes a cross-section to increase carrying capacity. Each car tub includes a longitudinal semi-circular floor plate formed by a cold-formed process. Additionally, each car plate includes a one-piece composite tub closure at each end thereof.

18 Claims, 7 Drawing Sheets

RAILROAD CAR TUB

The present application claims the benefit of U.S. Provisional Patent Application Serial No. 60/131,395, filed Apr. 28, 1999 entitled "Railroad Car Tub" which is incorporated herein by reference.

BACKGROUND OF THE INVENTION

1. Field of the Invention

The present invention relates to railcars, more specifically, the present invention relates to railcar tub designs.

2. Prior Art

In railcars, it has long been known to provide additional storage below the center sill in a pair of cargo areas formed between a center sill and a side sill, generally referred to as tubs. Examples of these types of railroad car designs can be found in U.S. Pat. Nos. 4,361,097 and 5,216,958. These existing designs include a pair of tubs extending longitudinally along the center sill with an end cap arrangement on each respective end of the tub. A full semi-circle is commonly utilized for the tub cross-section to provide the necessary strength to the tub. Presently, the end caps are constructed from a plurality of separate, connected pieces. Additionally, each end cap must include drain holes built into the end cap to allow egress of excess moisture in the tub. With the provision of multiple drain holes, a plurality of drain hole covers are provided with separate fasteners for each cover. The existing tub designs do not maximize the storage capacity available in the tub configurations. The current tub designs, particularly the end caps, represent a relatively complex structure increasing assembly time and manufacturing costs.

It is the object of the present invention to provide a railcar with an improved tub design overcoming the aforementioned drawbacks of the prior art. It is a further object of the present invention to provide a tub design with an improved cross-sectional configuration which is easy to manufacture and maintains the necessary structural integrity for the tub. A further object of the present invention is to provide a simplified tub closure at the respective ends of the tub.

SUMMARY OF THE INVENTION

The above objects are achieved with a railroad car tub according to our invention. The railroad car tub body of our invention includes a flat, horizontal base section running along the longitudinal length of the tub. A pair of curved sections extend from the horizontal base section to vertically extending attachment ends on either side of the tub body. The pair of curved sections may have an equal radius or each have a different radius. Additionally, each curved section may be formed of more the one radii. The center(s) of the radius of curvature for the curved sections will be spaced from each other. One attachment end is adapted to be attached by mechanical fasteners to the center sill, while the other vertically extending attachment end is adapted to be attached to a side sill of a railcar.

In one embodiment of the present invention, the cross-section of the railroad car tub body has a base section extending approximately one-fifth of the width of the tub while each of the curved sections have an inside radius of approximately two-fifths of the width. In one embodiment of the present invention, the railroad car tub body may be formed of aluminum plate formed in a cold-forming operation. Alternatively, the tub body may be formed of a composite material.

The railroad car tub of my invention additionally includes a one-piece tub closure at each end of the car tub body. The one-piece tub closure may be a composite structure or a press shaped aluminum structure. The one-piece tub closure includes a flat end member and an overlapping extension member extending away from the end member substantially along the longitudinal length of the car tub. A curved transition segment attaches the end member with the extension member. The extension member substantially conforms to the cross-sectional shape of the tub body with the exception of an arched drain formed generally at the bottom of the composite tub closure. The extension member includes a plurality of through holes to receive connecting members for attaching the one-piece tub closure to the car tub body and the center sill and side sill of the railcar. The end member additionally includes apertures along the top thereof for receiving fastener members therethrough.

The cross-sectional configuration of the car tub body of our invention increases the carrying capacity of the car tub over the prior art structure while maintaining the desired strength characteristics of the tub. Additionally, the one-piece tub closure of our invention significantly reduces the tub components reducing manufacturing and assembly costs. These and other advantages of the present invention will be clarified in the brief description of the preferred embodiments taken with the attached figures wherein like reference numerals represent like elements throughout.

DESCRIPTION OF THE PREFERRED EMBODIMENTS

Figure 1:
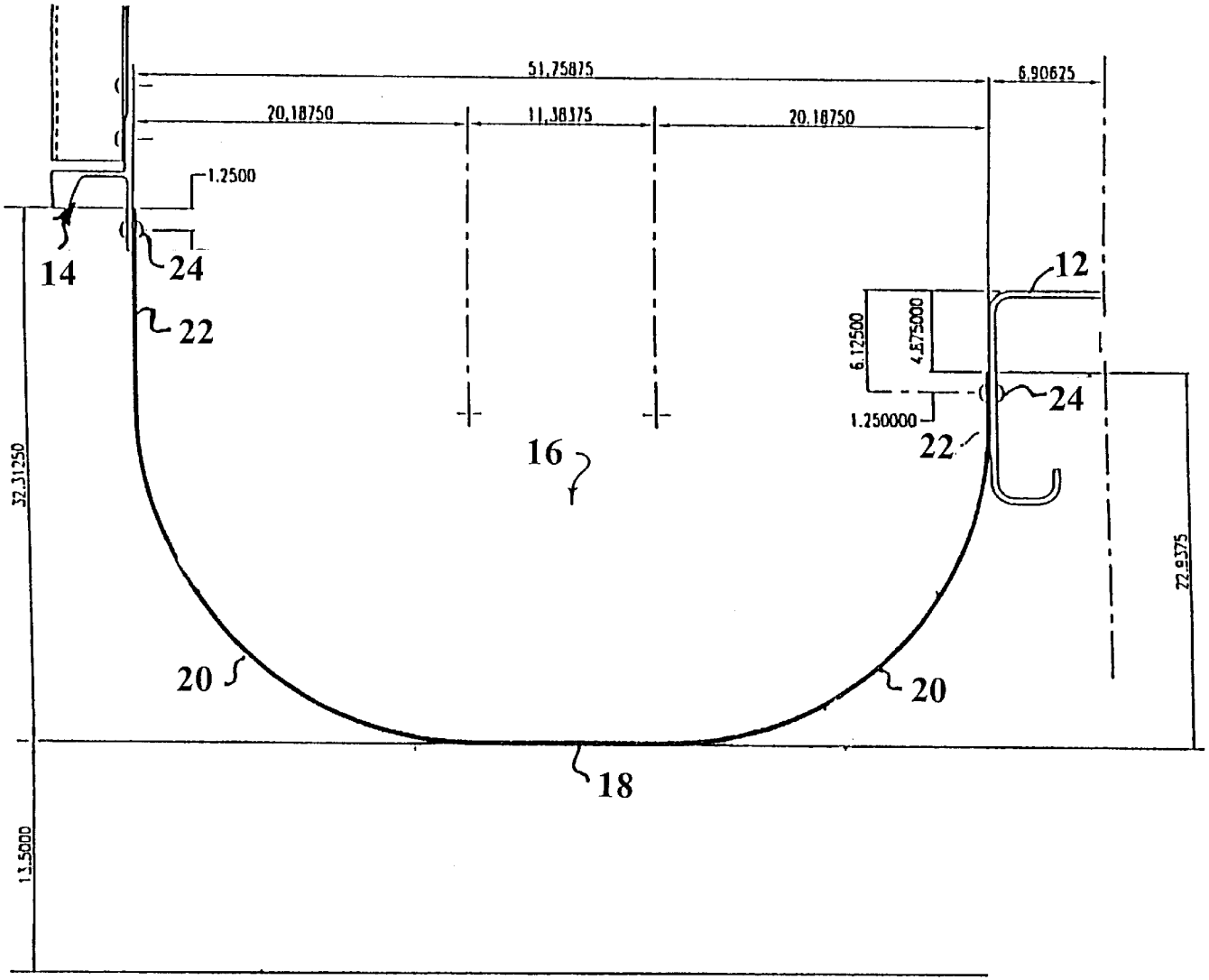
FIG. 1 is a cross-sectional view of a car tub body profile according to our invention.
Figure 6:
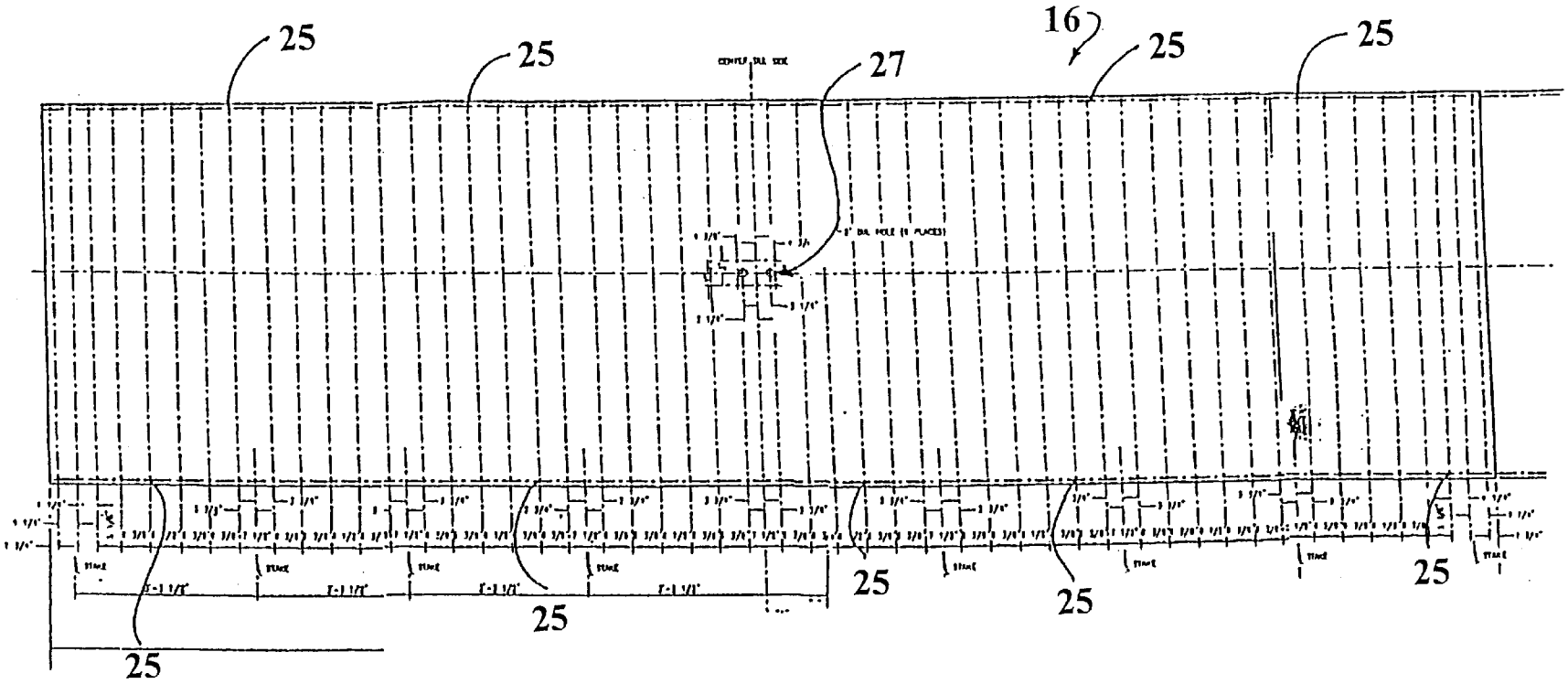
FIG. 6 is a plan view of a flat pattern of the car tub body.

A railcar according to my invention includes a center sill 12 extending the longitudinal length of the railcar with a pair of side rails 14 extending the longitudinal length of the car on opposed sides of the center sill 12 in a conventional fashion. A pair of tubs extend longitudinally along the length of the car between the center sill and each side rail. A portion of the center sill 12, one side sill 14 and one car tub body 16 of our invention are illustrated in FIG. 1. It will be understood that the mirror image of this construction will be provided on the opposite side of the center sill 12. As shown in FIG. 1, the cross-section of the car tub body 16 of our invention includes a horizontal, flat center base section 18 along the longitudinal center of the tub body 16. The base section 18 extends for about one-fifth of the overall horizontal width of the tub body 16, as shown in FIG. 1. In the illustrated embodiment, the base section 18 has a width of 11.38 inches and the car tub body 16 has a total width of 51.76 inches. A pair of curved sections 20 extend from opposite sides of the base section 18 to connect the horizontally extending base section 18 with vertically extending attachment ends 22 of the tub body 16. As shown in the figures, one attachment end 22 will extend higher than the other attachment end 22 of the tub body 16. Mechanical fasteners 24 can extend through holes 25 in the attachment ends 22 to attach the tub body 16 to the center sill 12 and side sill 14, respectively. The fasteners 24 will extend the longitudinal length of the tub body 16 at spaced locations as known in the art. FIG. 6 is a plan view of a flat pattern of the tub body 16 better illustrating the holes 25. A center drainage structure 27 may be included in the center of the tub as shown in FIG. 6. The curved sections 20 may have identical radii equal to approximately two-fifths of the width of the tub body 16, as shown in FIG. 1. In the embodiment shown in FIG. 1, the radii and the width of each curved section 20 are equal and are 20.19 inches, or roughly two-fifths of the width (51.76 inches) of the car tub body 16. Alternatively, the curved sections 20 may have different radii or each may be formed of more that one radius (i.e., the radius of curvature of a curved section 20 may change along the curved section 20). The tub body 16 can be formed from a flat aluminum plate in the pattern shown in FIG. 6 using a cold-forming process with the aluminum plate being approximately 3/16 of an inch thick. It is also contemplated that the tub body 16 can be formed from a composite material, in which case the tub body 16 is formed with the profile shown in FIG. 1. The composite material may provide additional weight savings to the railcar design, but the aluminum plate structure may be more economical to manufacture. All of these factors will be considered and balanced before selecting the material for the tub body 16. Finally, other materials may be used for the tub body 16, but aluminum plate and composite material are believed to provide better results due to the advantages discussed above.

Figure 2B:
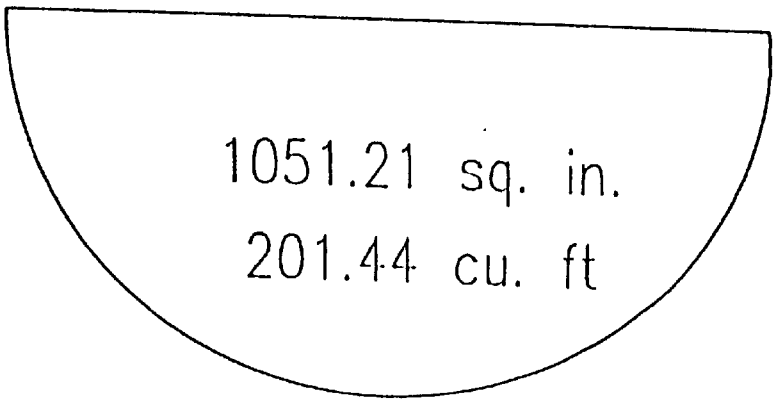
Prior Art Fig. 2b
FIGS. 2*a* and 2*b* illustrate the relative carrying capacities of a car tub having the tub body profile of our invention and a car tub of the prior art, respectively.
Figure 2A:
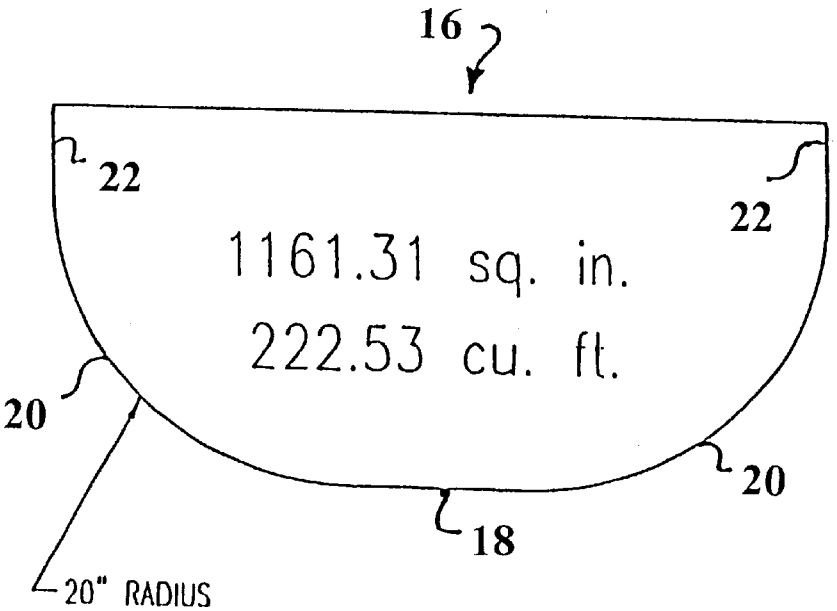

As shown in the comparative FIGS. 2*a* and 2*b*, the cross-sectional configuration of the tub body 16 provides an increase of approximately 10 percent in the carrying capacity of the tub over the semi-circular configuration of the prior art. Additionally, the car tub of the present invention provides a tub body profile which is easily cold-formed to simplify the manufacturing process, when using metal plate such as aluminum. Furthermore, the profile of the tub body 16 provides sufficient structural integrity to the tub such that the tub body 16 is not limited to only specialized materials. As will be apparent to those skilled in the art, the increase of carrying capacity of the railcar in the tub design provides the additional advantage of lowering the overall center of gravity of the railcar of the present invention, thereby providing a more stable railcar design.

Figure 3A:
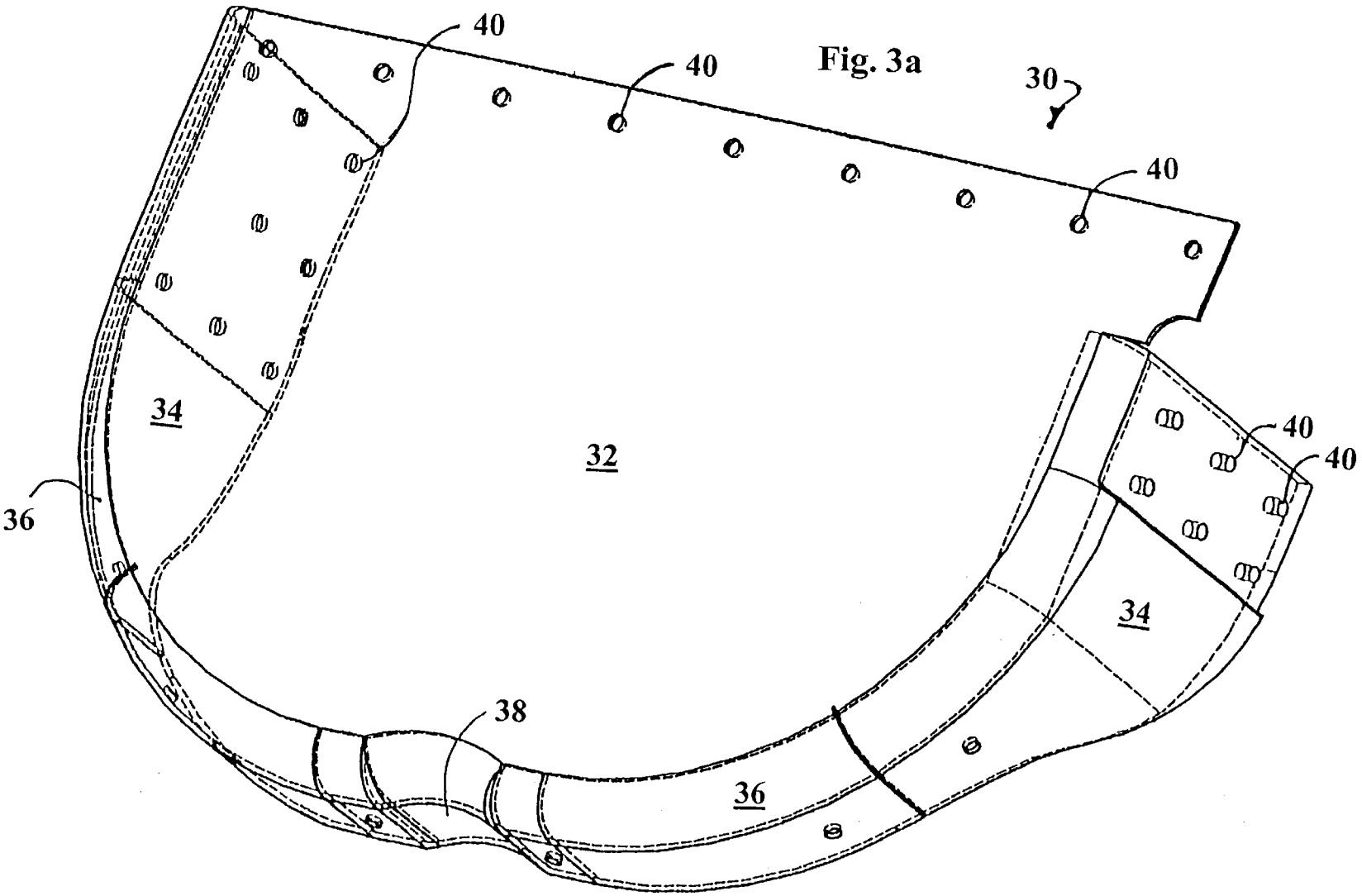
FIGS. 3*a* and 3*b* are perspective views of a composite tub closure for the railroad car tub of our invention.
Figure 3B:
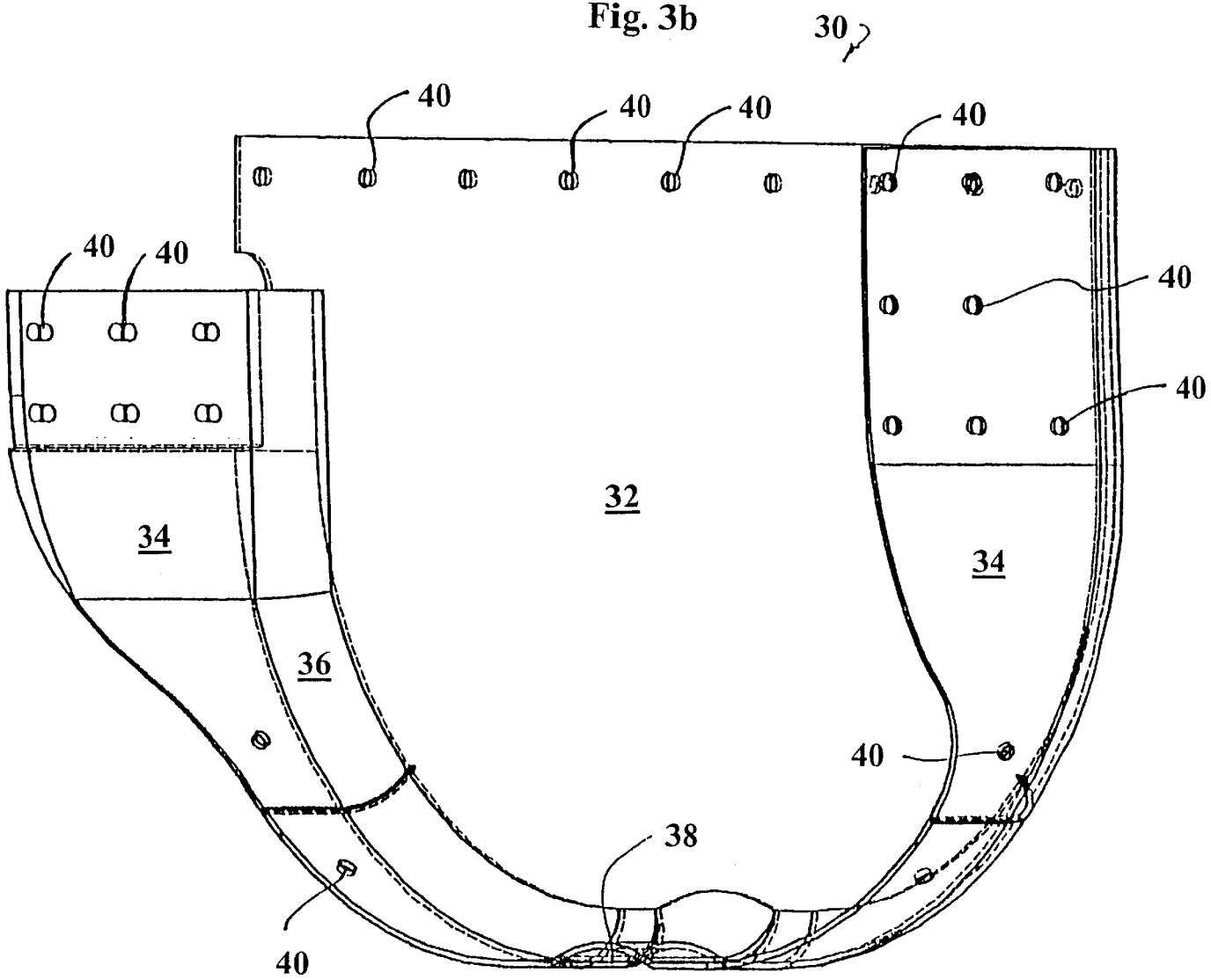
Figure 4:
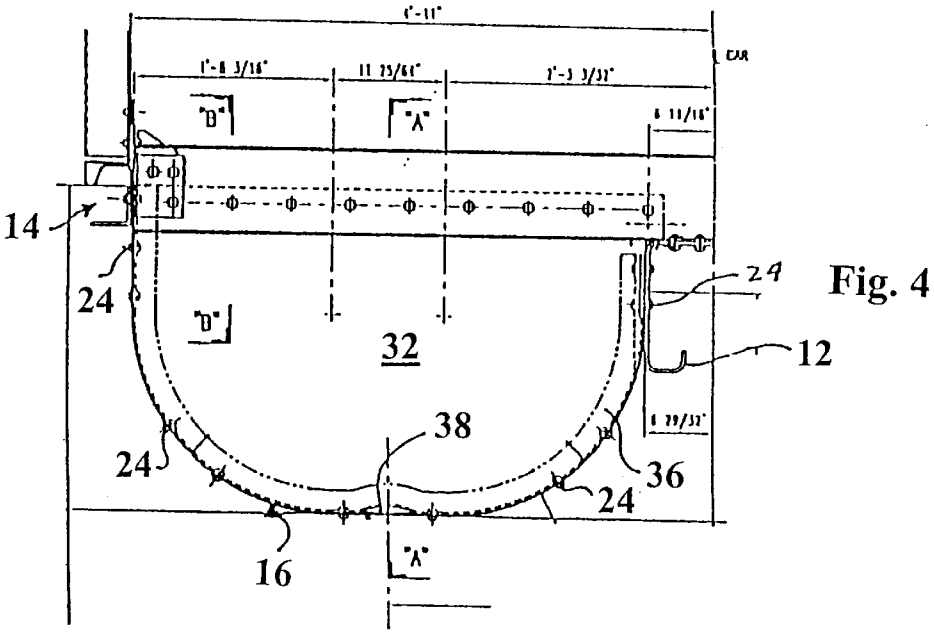
FIG. 4 is an end view of the composite tub closure of the railroad car tub of our invention.
Figure 5A:
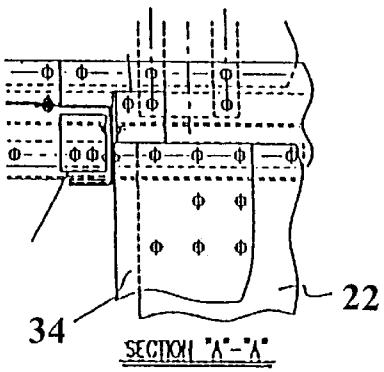
FIGS. 5*a*, 5*b* and 5*c* are partial cross-sectional views of the composite tub closure illustrated in FIG. 4.
Figure 5B:
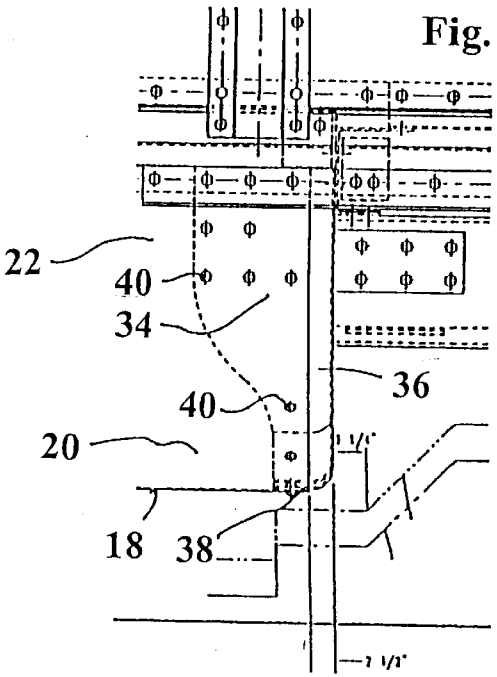
Figure 5C:
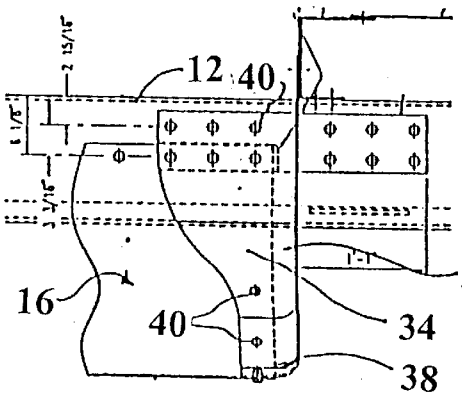

FIGS. 3*a* and 3*b* illustrate a one-piece composite tub closure 30 for closing the longitudinal ends of the tub body 16 of our invention. The composite closure 30 is a one-piece, integral member which includes a planar end member 32 and an extension member 34 extending substantially perpendicular to the end member 32 extending in a direction away from the end member 32. The extension member 32 extends around the end member 32 in substantially the same shape as tub body 16, as shown in FIGS. 3*a* and 3*b*. A curved transition segment 36 connects the planar end member 32 with the extension member 34. The extension member 34 extends substantially the same shape as the tub body 16 except that the bottom of the extension member 34 is arched away from the tub body 16 to form a drain 38. Drain 38 allows egress of moisture from within the car tub. The extension member 34 and the top of the end member 32 include apertures 40 which are adapted to receive conventional fasteners therethrough, such as fasteners 24, for attachment of the composite tub body closure 30 to the tub body 16 and other associated structures as illustrated in FIG. 4 and FIGS. 5*a*, 5*b* and 5*c*. As shown in FIGS. 3 and 5, the portions of the extension member 34 extending along vertical attachment ends 22 of the tub body 16 have an increased length than other portions of the extension member 34 to accommodate stress concentrations at these connecting sections.

As will be apparent to those of ordinary skill in the art a tub closure 30 is attached at each end of the tub body 16 to close off the respective ends of the car tub. The tub closure 30 of the present invention replaces nine pieces in existing prior art closures, significantly reducing manufacturing costs. Additionally, the composite closure design of the present invention accommodates the high stress locations associated with tub closure 30. The single drain 38 provides the appropriate drainage for the car tub 16 and significantly reduces the drain holes over the prior art structures. The use of the one-piece composite tub closure 30 of the present invention is believed to significantly reduce fabrication and assembly time for railroad car tubs. The one-piece tub closure 30 may also be formed as a pressed aluminum structure. Furthermore, the present invention provides that if the tub body 16 is formed of a composite material together with the tub closure 30, then the composite closure 30 may be formed integral with the composite tub body 16.

Figure 7:
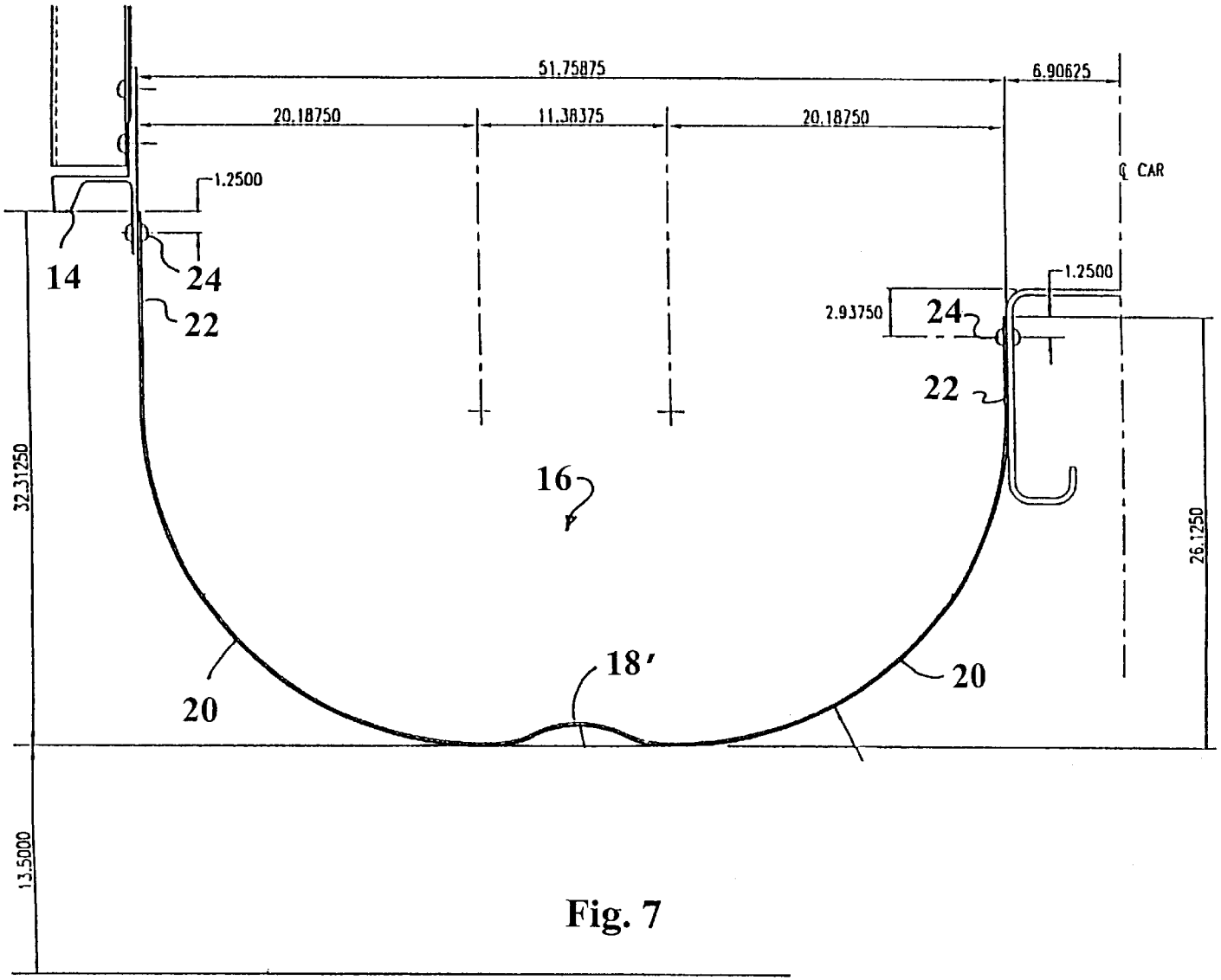
FIG. 7 is a cross-sectional view of a modified car tub body profile.

FIG. 7 illustrates a possible modification of the tub body 16. The modified car tub body 16 shown in FIG. 7 includes an upwardly curved center section 18' along the longitudinal center of the tub body 16. The curved section 18' extends for about one-fifth of the overall horizontal width of the tub body 16, as shown in FIG. 7, between the pair of curved sections 20. The curved sections 20 and the vertically extending attachment ends 22 of the tub body 16 are the same as described above in connection with claim 1. The upwardly curved section 18' is designed to allow some flexing to the design under loading. The cross-sectional shape of FIG. 7 still provides an increased carrying capacity over the prior art structure, but not as great as the profile shown in FIG. 1.

It will be apparent to those of ordinary skill in the art that various modifications may be made to the present invention without departing from the spirit and scope thereof. The scope of the present invention is defined by the appended claims and equivalents thereto.

We claim:

1. A railroad car comprising a center sill and a pair of car tubs extending longitudinally along the center sill, each said car tub including a pair of curved portions each having a substantially constant radius of curvature and extending from opposed sides of a center section to vertically extending end sections of said car tub, wherein center-points defining respective radii of curvatures for said pair of curved portions are horizontally spaced from each other and positioned along the same horizontal plane.

2. The railroad car of claim 1, further including at least one one-piece tub closure at one end of one said car tub.

3. The railroad car of claim 2, wherein said at least one one-piece tub closure is formed of a composite material.

4. The railroad car of claim 1, wherein said at least one one-piece tub closure is formed of aluminum.

5. The railroad car of claim 1, wherein said center section of each said tub is a flat portion and said radii of curvature are substantially equal.

6. The railroad car of claim 1, wherein said tub is formed of a composite material.

7. The railroad car of claim 1, wherein said tub is formed as a cold formed aluminum member.

8. A railroad car comprising a center sill and a pair of car tubs extending longitudinally along the center sill and at least one one-piece tub closure at one end of one said car tub, wherein the one-piece tub closure includes a planar end member and an extension member extending substantially perpendicular away from said end member, wherein said extension member extends around said end member in substantially the same shape as said tub, a curved transition segment connecting said planar end member with said extension member, and a drain member arched away from said tub to form a drain allowing egress of moisture from within said tub.

9. The railroad car of claim 8, wherein each said car tub includes a pair of curved portions extending from opposed sides of a center section to vertically extending end sections of said car tub, wherein center-points defining at least a portion of respective radii of curvature for said pair of curved portions are horizontally spaced from each other.

10. The railroad car of claim 9, wherein said center section of each said tub is a horizontally extending flat portion.

11. The railroad car of claim 10, wherein said flat center section extends for about one-fifth of the overall width of the tub.

12. The railroad car of claim 8, wherein each said one-piece tub closure is formed composite material.

13. The railroad car of claim 12, wherein each said tub is formed of composite material.

14. The railroad car of claim 12, wherein each said tub is formed as a cold formed aluminum member.

15. A railroad car comprising a center sill and a pair of car tubs extending longitudinally along the center sill and at least one one-piece tub closure at one end of one said car tub, wherein each said car tub includes a pair of curved portions extending from opposed sides of a center section to vertically extending end sections of said car tub, wherein center-points defining at least a portion of respective radii of curvature for said pair of curved portions are horizontally spaced from each other by a distance of about one-fifth of the width of said tub.

16. A railroad car comprising:

a center sill; and a pair of car tubs extending longitudinally along the center sill, wherein each said car tub is formed of a composite material, wherein each said car tub includes a pair of curved portions extending from opposed sides of a flat center section to vertically extending end sections of said car tub, wherein center-points defining at least a portion of respective radii of curvature for said pair of curved portions are horizontally spaced from each other and wherein said flat center section extends for about one-fifth of the overall width of the tub.

17. The railroad car of claim 16, wherein said center section of each said tub is a horizontally extending flat portion.

18. The railroad car of claim 15, wherein each said car tub includes a composite tub closure.

* * * * *